United States Patent [19]

Horowitz

[11] 4,113,333

[45] Sep. 12, 1978

[54] ELECTRICAL CONNECTOR RECEPTACLE

[75] Inventor: Charles Horowitz, Niles, Ill.

[73] Assignee: Sloan Valve Company, Franklin Park, Ill.

[21] Appl. No.: 799,506

[22] Filed: May 23, 1977

[51] Int. Cl.[2] ..... H01R 3/06

[52] U.S. Cl. ..... 339/14 P; 339/10; 339/75 P; 339/79; 339/217 R; 339/277 R

[58] Field of Search ..... 339/14 P, 10, 76, 79, 339/75 P, 75 A, 75 M, 75 R, 217 R, 277 R

[56] References Cited

U.S. PATENT DOCUMENTS

| | | | |
|---|---|---|---|
| 3,573,720 | 4/1971 | Reynolds | 339/217 R |
| 3,915,476 | 10/1975 | Burkle | 339/75 P X |

*Primary Examiner*—Roy Lake
*Assistant Examiner*—DeWalden W. Jones
*Attorney, Agent, or Firm*—Kinzer, Plyer, Dorn & McEachran

[57] ABSTRACT

A connector receptacle which includes removably locked male contact pins, a locking plate and an end plate. The locking plate can either secure the male contact pins in position or allow removal of the male contact pins.

11 Claims, 7 Drawing Figures

ELECTRICAL CONNECTOR RECEPTACLE

SUMMARY OF THE INVENTION

The present invention relates to electrical connector receptacles particularly adapted for use in tractor-trailer combinations.

A conventional receptacle will have male contact pins permanently attached to the receptacle end plate. The electrical harness wires are then secured to the contact pins. A primary purpose of the present invention is to allow the preassembly of the male contact pins to the electrical harness before assembling the pins within the receptacle.

Another purpose is a receptacle assembly which allows the contact pins to be removed if they have been inserted in an improper position and reinserted in the correct position.

Another purpose is an assembly of the type described in which broken or bent pins are more easily removed and replaced.

Another purpose is a receptacle assembly of the type described in which loose or broken pin-wire connections can easily be repaired.

A feature of this receptacle assembly is that the male contact pins may be secured in the locked position by the locking plate; or the contact pins may be unsecured and removed by loosening a locking screw and shifting the locking plate to the unlocked position.

Other purposes will appear in the ensuing specification, drawings and claims.

BRIEF DESCRIPTION OF THE DRAWINGS

The invention is illustrated diagrammatically in the drawings wherein.

DESCRIPTION OF THE PREFERRED EMBODIMENT

The electrical connector receptacle assembly is indicated generally at 10 and is utilized with a conventional connector plug in forming an electrical connection between the tractor and the trailer of a tractor-trailer truck combination. The particular construction of the receptacle assembly lends itself to such application although the invention should not be so limited.

Figure 1:
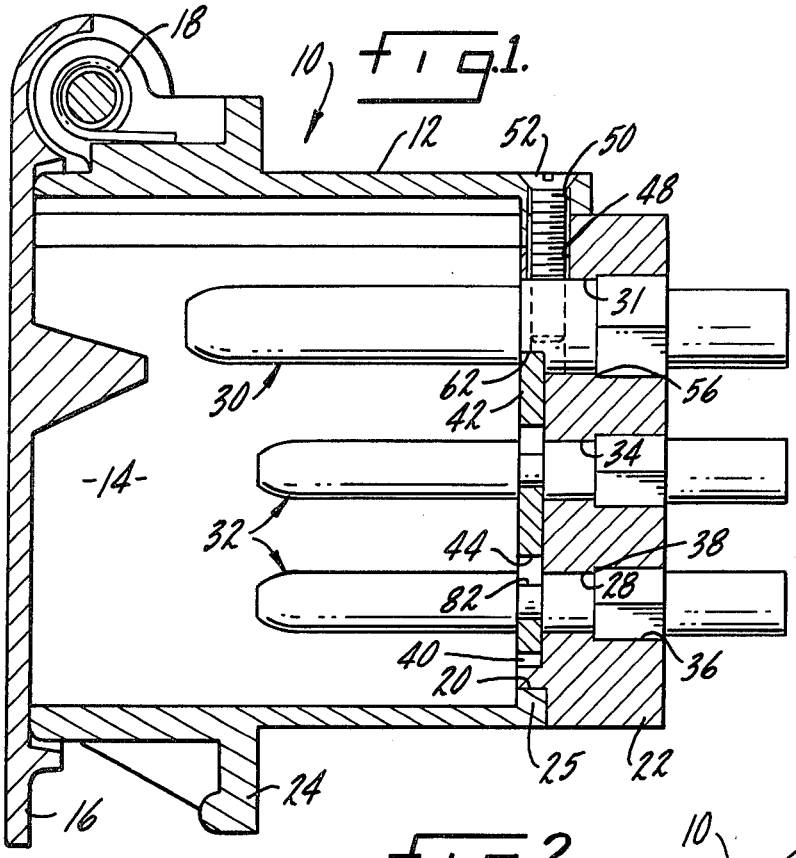
FIG. 1 is a section through the connector receptacle.

Turning particularly to the receptacle as shown in FIG. 1, a hollow housing is indicated at 12 and may be generally cylindrical in form. The left-hand end of the housing 12 has an open end 14, closed by a hinged cover 16. Cover 16 is biased by coil spring 18 to the closed position. The opposite end of housing 12 has an opening 20 closed by end plate 22.

Extending outwardly from opposite sides of housing 12 are conventional mounting flanges 24 for use in mounting the receptacle to a truck.

End plate 22 fits within open end 20 of the housing 12 and is prevented from passing into housing interior 14 by housing shoulder 25. Looking particularly at FIG. 1, five small end plate apertures 28 and one large end plate aperture 31 are spaced about a centrally located small end plate aperture 34. Each small end plate aperture 28 receives a small male contact pin 32 and large end plate aperture 31 receives a large male contact pin 30. Large male contact pin 30 only allows communication with a large female contact pin of a conventional plug (not shown) to insure proper electrical alignment. Pin 30 may also serve as a grounding pin. A color code may appear about apertures 28, 31, 34 to aid in inserting the electrically proper contact pins into end plate 22.

As best seen in FIG. 1, a hex-shaped counterbore 36 is provided at the exterior portion of end plate apertures 28 and 34 to define shoulders 38 which prevent insertion of contact pins beyond the shoulder. A similar shoulder 56 is formed in aperture 31.

Figure 3:
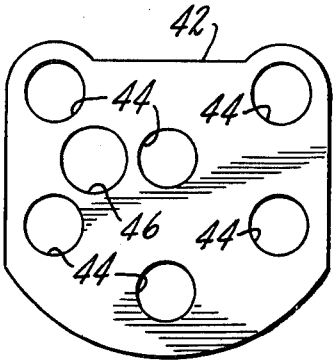
FIG. 3 is a front view of the locking plate.
Figure 2:
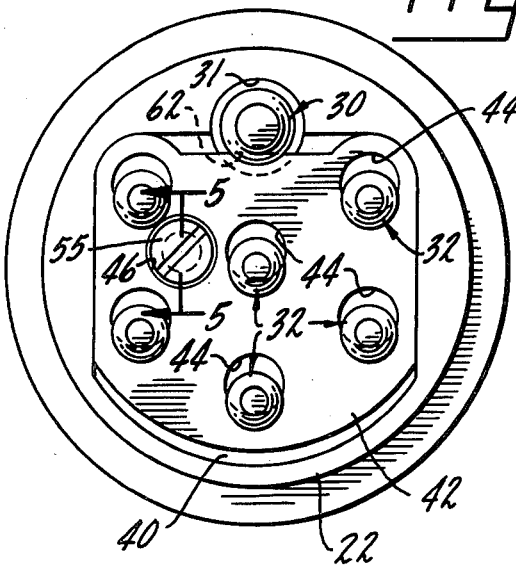
FIG. 2 is a front view of the receptacle assembly showing the locking plate.
Figure 4:
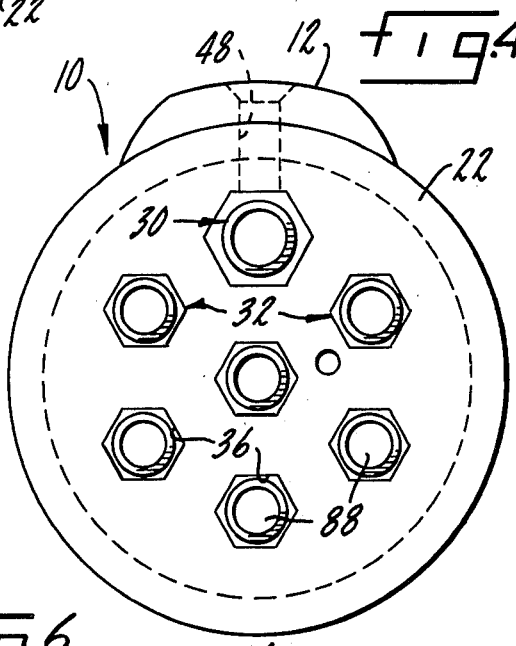
FIG. 4 is an end view of the receptacle viewed from the right-hand side of FIG. 1.
Figure 5:
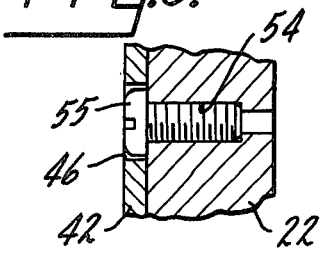
FIG. 5 is a sectional side view of the locking plate screw, taken on line 5—5 of FIG. 2.

At the interior face of end plate 22 there is recess 40 of the same general shape, depth, width, but lightly longer length than locking plate 42 shown in FIG. 3. As seen in FIG. 1, there is a clearance hole 48 in the side of end plate 22. Hole 48 aligns with clearance holes 50 in receptacle housing 12 to receive screw 52 which secures housing 12 and end plate 22. Screw 52 also secures large male contact pin 30 to end plate 22. As seen in FIG. 5, a threaded hole 54 opening to the interior face of end plate 22 is provided for securing locking plate 42 in place.

Locking plate 42 is provided with six male contact pin apertures 44, arranged in the same pattern as the six small male contact pin locking plate apertures 28, 34 in end plate 22. Locking plate 42 is also provided with hole 46, slightly larger in diameter than the head of locking plate screw 55 as shown in FIG. 5. With locking plate 42 fitted within end plate recess 40, locking plate 42 may be secured in the locked position by screw 55.

Figure 6:
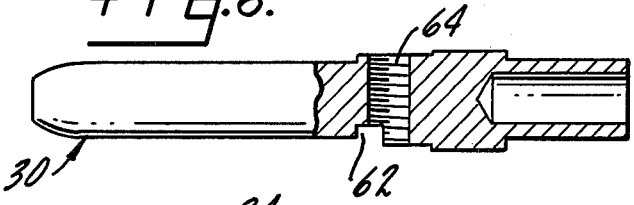
FIG. 6 is a partial sectional view of the large male contact pin.
Figure 7:
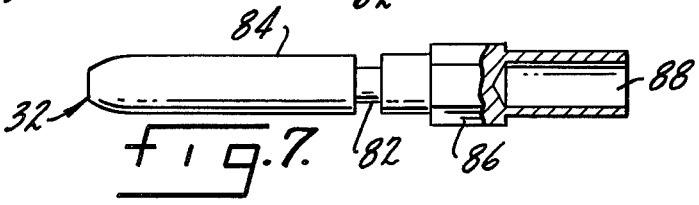
FIG. 7 is a partial sectional view of the small contact pin.

The large and small male contact pins 30, 32 are shown in detail at FIGS. 6 and 7, respectively. Contact pin 32 has a generally cylindrical front portion 84 and an annular locking groove 82 positioned to allow communication with locking plate 42. A hex-shaped portion 86 is of a size and shape to fit within hex-shaped counterbore 36 of end plate 22. Adjacent to portion 86 is rear crimping portion 88, with a bore opening to the rear of sufficient size to accept standard electrical wires to form a crimping connection with the contact pin 32.

Large male contact pin 30 is of similar construction except that locking slot 62 does not extend around contact pin 30. Also, there is a threaded hole 64 in pin 30 which accepts screw 52 as seen in FIG. 1. Screw 52 may also be used to fasten a grounding wire to receptacle housing 12.

In assembly, contact pins 30, 32 may be preassembled to an electrical harness by the above-described crimp connection.

With locking screw 55 backed out of the hole a sufficient distance, locking plate 42 may be easily shifted back and forth against the front face of end plate 22 within recess 40 by means of a conventional screw driver tip. With locking plate 42 in the unlocked position, male contact pins 32 may be inserted through end plate apertures 28 and locking plate apertures 44 up to a point where shoulder 38 prevents further pin insertion.

Locking plate 42 may now be shifted to the locked position, engaging the plate with contact pin grooves 62 and 82. Thus, in the locked position withdrawal of male contact pins 30, 32 is prevented by locking plate 42, while further insertion is prevented by shoulders 38 and 56. Locking plate 42 can be secured in the locked position by locking plate screw head 55 acting against the sides of hole 46. If the male connector pins are inadvertently inserted in an improper position, or if the wire connection is faulty, locking plate 42 can be shifted or moved to the unlocked position and contact pins 30, 32 withdrawn and then properly placed or repaired.

As shown in FIG. 5, locking plate screw 55 need not be completely removed from hole 46 to free locking plate 42. This arrangement prevents an assembler from losing screws during field repairs or factory assembly.

After assembly of the contact pins as described, plate 42 is secured in the locked position by locking screw 55. The pins, locking plate and end plate are then secured to the receptacle housing by screw 52.

Whereas the preferred form of the invention has been shown and described herein, it should be realized that there may be many modifications, substitutions and alterations thereto.

The embodiments of the invention in which an exclusive property or privilege is claimed are defined as follows:

1. In an electrical connector receptacle including a hollow housing having an end plate at one end and a closing cover at the opposite end, said end plate having a plurality of pin apertures extending therethrough, a plurality of male contact pins extending through said pin apertures and insertable from the outside of said end plate, cooperating means on said pins and pin apertures for limiting the extent to which said pins are inserted into said pin apertures, each of said pins having an annular groove, a locking plate positioned adjacent the inner wall of said end plate and slidable thereon, and means on said locking plate cooperating with the grooves in said pins for removably locking said pins in said pin apertures.

2. The electrical connector receptacle of claim 1 in which said end plate is secured in said housing by a screw which serves as a grounding connection, one of said pins serving as a ground contact pin engaged by said screw.

3. The electrical connector receptacle of claim 1 in which the contact pins are located in spaced circular arrangement around the end plate and project into said housing through the apertures of said locking plate.

4. In an electrical connector receptacle including a hollow housing having an end plate and a closing cover, said end plate having a plurality of contact pin apertures extending therethrough, a plurality of male contact pins insertable through said pin apertures, means for limiting insertion of said pins in said apertures, a locking plate movable on the interior surface of said end plate, and cooperating means on said pins and said locking plate for removably securing said pins in said end plate.

5. In an electrical connector receptacle including a hollow housing, an end plate supported at one end of said housing and a cover plate at the other end, said end plate having a plurality of spaced contact pin apertures extending therethrough, a plurality of male contact pins extending through said pin apertures, means for limiting insertion of said pins in said pin apertures, each of said pins having an annular groove, a locking plate slidable along the inner wall of said end plate, said locking plate having a plurality of apertures therein, said pins projecting through said locking plate apertures, said locking plate engaging said pin grooves to securely lock said contact pins in said end plate.

6. The electrical connector receptacle of claim 5 in which the locking plate is secured in pin locking position by a screw threaded into said end plate through an aperture in said locking plate.

7. An electrical connector receptacle including a housing, one end of said housing having an opening and cover therefor, the opposite end of said housing having an end plate, said end plate having a plurality of apertures therein, said end plate also having a recess therein, a locking plate shiftable within said recess, said locking plate having a plurality of male contact pin apertures therein, a plurality of male contact pins in said housing extending through said end plate apertures and said locking plate apertures, and means for removably locking said male contact pins to said locking plate.

8. The electrical connector receptacle of claim 7 further characterized in that said recess is located on the inner face of said end plate.

9. The electrical connector receptacle of claim 7 further characterized by means for securing said locking plate to said end plate.

10. The electrical connector receptacle of claim 9 further characterized by a threaded hole in said end plate and a hole in said locking plate, and a locking screw extending in said holes to lock said locking plate to said end plate.

11. The electrical connector of claim 10 further characterized in that said locking plate is slightly larger in diameter than said locking screw head whereby said locking plate is movable without completely removing said locking screw from said holes.

* * * * *